US010329913B2

(12) United States Patent
Sadler

(10) Patent No.: US 10,329,913 B2
(45) Date of Patent: Jun. 25, 2019

(54) TURBINE DISC ASSEMBLY

(71) Applicant: ROLLS-ROYCE plc, London (GB)

(72) Inventor: Keith C Sadler, Bristol (GB)

(73) Assignee: ROLLS-ROYCE plc, London (GB)

( * ) Notice: Subject to any disclaimer, the term of this patent is extended or adjusted under 35 U.S.C. 154(b) by 395 days.

(21) Appl. No.: 15/207,833

(22) Filed: Jul. 12, 2016

(65) Prior Publication Data

US 2017/0044902 A1 Feb. 16, 2017

(30) Foreign Application Priority Data

Aug. 12, 2015 (GB) ..... 1514212.8

(51) Int. Cl.

*F01D 5/02* (2006.01)
*F01D 5/08* (2006.01)
*F01D 11/00* (2006.01)

(52) U.S. Cl.

CPC ..... *F01D 5/087* (2013.01); *F01D 5/025* (2013.01); *F01D 5/082* (2013.01); *F01D 11/003* (2013.01); *F01D 11/005* (2013.01); *F05D 2220/32* (2013.01); *F05D 2240/55* (2013.01); *F05D 2260/232* (2013.01)

(58) Field of Classification Search

CPC ..... F01D 5/025; F01D 5/082; F01D 5/087; F01D 11/003; F01D 11/005; F01D 2260/232; F05D 2220/32; F05D 2240/55

See application file for complete search history.

(56) References Cited

U.S. PATENT DOCUMENTS 3,644,058 A 2/1972 Barnabei et al.
3,814,539 A * 6/1974 Klompas ..... F01D 5/081 415/115
4,086,757 A 5/1978 Karstensen et al.
4,192,633 A * 3/1980 Herzner ..... F01D 5/10 415/119
4,582,467 A * 4/1986 Kisling ..... F01D 5/3015 415/115
4,701,105 A * 10/1987 Cantor ..... F01D 5/3015 416/220 R
4,822,244 A * 4/1989 Maier ..... F01D 5/082 415/115

(Continued)

FOREIGN PATENT DOCUMENTS

GB 631152 A 10/1949
GB 2081392 A 2/1982

(Continued)

OTHER PUBLICATIONS

Jan. 13, 2016 Search Report issued in Great Britain Patent Application No. GB1514212.8.

(Continued)

*Primary Examiner* — Igor Kershteyn
(74) *Attorney, Agent, or Firm* — Oliff PLC

(57) ABSTRACT

A turbine disc assembly comprises a turbine disc mounted coaxially on a shaft and, in use, arranged in the path of a hot work fluid flow. A cover plate is axially displaced from the turbine disc in a direction upstream with respect to the work fluid flow. The cover plate comprises a radially inner annular disc component and a radially outer annular disc component, the annular disc components are arranged coaxially with each other.

18 Claims, 4 Drawing Sheets

(56) References Cited

U.S. PATENT DOCUMENTS

| | | | | |
|---|---|---|---|---|
| 5,143,512 | A * | 9/1992 | Corsmeier | F01D 5/082 415/115 |
| 5,226,785 | A | 7/1993 | Narayana et al. | |
| 6,077,035 | A * | 6/2000 | Walters | F01D 5/081 415/115 |
| 6,106,234 | A * | 8/2000 | Gabbitas | F01D 5/3015 416/220 R |
| 6,749,400 | B2 * | 6/2004 | Dougherty | F01D 5/081 415/115 |
| 7,331,763 | B2 * | 2/2008 | Higgins | F01D 5/08 415/176 |

FOREIGN PATENT DOCUMENTS

| | | | |
|---|---|---|---|
| WO | 99/50534 | A1 | 10/1999 |
| WO | 2015/038605 | A1 | 3/2015 |

OTHER PUBLICATIONS

Jan. 4, 2017 European Search Report issued in Patent Application No. EP 16 17 9004.

* cited by examiner

TURBINE DISC ASSEMBLY

FIELD OF THE DISCLOSURE

The invention concerns turbine discs. More particularly the invention provides a novel cover plate assembly for a turbine disc and means for attaching the cover plate to the disc.

BACKGROUND

In a gas turbine engine, ambient air is drawn into a compressor section. Alternate rows of stationary and rotating aerofoil blades are arranged around a common axis, together these accelerate and compress the incoming air. A rotating shaft drives the rotating blades. Compressed air is delivered to a combustor section where it is mixed with fuel and ignited. Ignition causes rapid expansion of the fuel/air mix which is directed in part to propel a body carrying the engine and in another part to drive rotation of a series of turbines arranged downstream of the combustor. The turbines share rotor shafts in common with the rotating blades of the compressor and work, through the shaft, to drive rotation of the compressor blades.

It is well known that the operating efficiency of a gas turbine engine is improved by increasing the operating temperature. The ability to optimise efficiency through increased temperatures is restricted by changes in behaviour of materials used in the engine components at elevated temperatures which, amongst other things, can impact upon the mechanical strength of the blades and rotor disc which carries the blades. This problem is partly addressed by shielding components from the hot combustion products with cover plates. It is also known to actively cool components by providing a flow of coolant through and/or over the turbine rotor disc and blades. It is known to take off a portion of the air output from the compressor (which is not subjected to ignition in the combustor and so is relatively cooler) and feed this to surfaces in the turbine section which are likely otherwise to suffer damage from excessive heat.

FIG. 2 shows a known arrangement for a turbine disc assembly. As can be seen from the figure, a turbine blade 9 is fed with high pressure coolant (for example compressed air which has by-passed the combustor) via a channel 2 in the disc rim. The coolant arrives at the turbine section in a chamber 8 formed by a casing under the combustor (not shown). The coolant passes through transfer holes 4 in a cover plate 5 which is arranged downstream of the chamber 8 and upstream of the main turbine disc body 10, it is then ducted radially outwards through a passage 3 which is formed between the cover plate 5 and the main turbine disc body 10. Its pressure is maintained using seals. Annular seal plate 12 suspends from an adjacent stator guide vane 13 to form, with an axial projection of the cover plate 5 a seal to prevent hot gases from the working fluid entering the region adjacent the disc body 10. The cover plate 5 is mounted at its radially inner end by means of a flange 6 which connects to a shaft on which the disc body 10 rotates and is held in position with respect to the disc body 10 by means of an annular rim 11 on the disc which defines a radially extending slot into which a radially outer edge 1 of the cover plate 5 is received. Since the coolant is directed radially outwardly in the passage 3 from the cooling holes 4 to the channel 2, a radially inner section of the disc body extending to the cooling holes 4 is shielded from oncoming work fluid and coolant.

The invention provides an alternative disc body and cover plate assembly which is expected to provide cost savings and improved engine performance/engine life extending benefits.

SUMMARY OF INVENTION

According to some embodiments of the invention there is provided a turbine disc assembly comprising a turbine disc mounted coaxially on a shaft and, in use, arranged in the path of a hot work fluid flow, a cover plate axially displaced from the turbine disc in a direction upstream with respect to the work fluid flow and an annular seal plate arranged adjacent an outer rim of the turbine disc to prevent the hot work fluid flow from penetrating a space axially adjacent the turbine disc, the cover plate comprising a radially inner annular disc component and a radially outer annular disc component, the annular disc components arranged coaxially with each other.

The annular disc components may be arranged in radial alignment. Alternatively, there may be a small axial gap between the annular disc components. In the latter case, there may be a radial overlap between the radially inner and radially outer annular disc components. Optionally, the two components are coupled together. A coupling may be configured to permit relative axial and/or radial movement of the inner and outer annular disc components with respect to one another.

The annular disc components may be axi-symmetric or non-axisymmetric. An optional gap between the annular disc components may be radially and/or axially positioned. Optionally, the gap is sealed against ingress of fluids arriving from upstream. Optionally, the gap is in fluid communication with an outlet of a supply of coolant for cooling a disc protected by the shield. The radially outer annular disc component may be provided with an annular array of coolant transfer holes through which coolant is delivered to a cavity between the outer annular disc component and the disc. The arrangement and configuration of the array is not crucial to the invention. The skilled addressee will be capable of optimising the features of such an array to suit specific operating parameters of a given turbine in which the assembly is to be incorporated.

Either or both of the components may incorporate a seal. For example (but without limitation), a seal might comprise an annular flanged portion or a radial extension having a wedged or stepped profile. For example, a seal portion extending from the radially outer annular disc component of the cover plate coorperates with a seal portion of the annular seal plate to form a seal against ingress of hot work fluid. The skilled person will understand that the relative spans of the two components can be optimised to suit different operating parameters, for example (but without limitation) the temperature of the work fluid and coolant fluid, the speed of flow of these fluids, characteristics of blades carried by the disc, materials used for the two components and mechanical properties of the disc to be shielded. For example, the outer radius of the inner annular disc component may be greater than 0.6 times the radius of the disc radius.

The radially outer component may be secured to the turbine disc. The radially inner component may be secured to the shaft. Alternatively, the radially inner component may be secured to the disc.

Either or both of the annular disc components may be attached to the disc by means of one or more radial spigots.

The inner annular disc component may be attached to the shaft by means of a flange. The inner annular disc component may be self-supporting.

The radially inner annular component may comprise a different material from the radially outer annular component. For example, the annular components both comprise an alloy and the inner annular disc component comprises a lower grade alloy than that of the outer annular component. The separation of the cover plate into radially inner and outer components permits the components (which are subjected to quite different loads and thermal ranges) to be manufactured from different materials. For example, the material of the radially inner component can be a less expensive, lower grade material than that of the radially outer component since the inner component is subjected to significantly lesser centrifugal induced stress loads compared to a comparable radially inner extent of a single component shield.

The radially inner annular component may be thinner in an axial dimension than the radially outer annular component. The radially inner component is less susceptible to high stresses induced by centrifugal loading. Also, since there is a radially increasing temperature gradient in an operational gas turbine engine, the radially inner component is not exposed to the extent of high temperatures experienced by the radially outer component. As such, the radially inner component can be smaller (thinner) and made from a lower grade material than the outer component.

The disc may be a turbine rotor disc configured for use in the high pressure turbine section of a gas turbine engine, though applications of the invention are not strictly limited to rotor discs or high pressure turbines.

In another aspect, the invention comprises a gas turbine engine incorporating one or more turbine disc assemblies in accordance with the described first aspect of the invention.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DESCRIPTION OF THE DRAWINGS

Embodiments of the invention will now be further described by way of example and with reference to the accompanying drawings in which.

DETAILED DESCRIPTION

Figure 1:
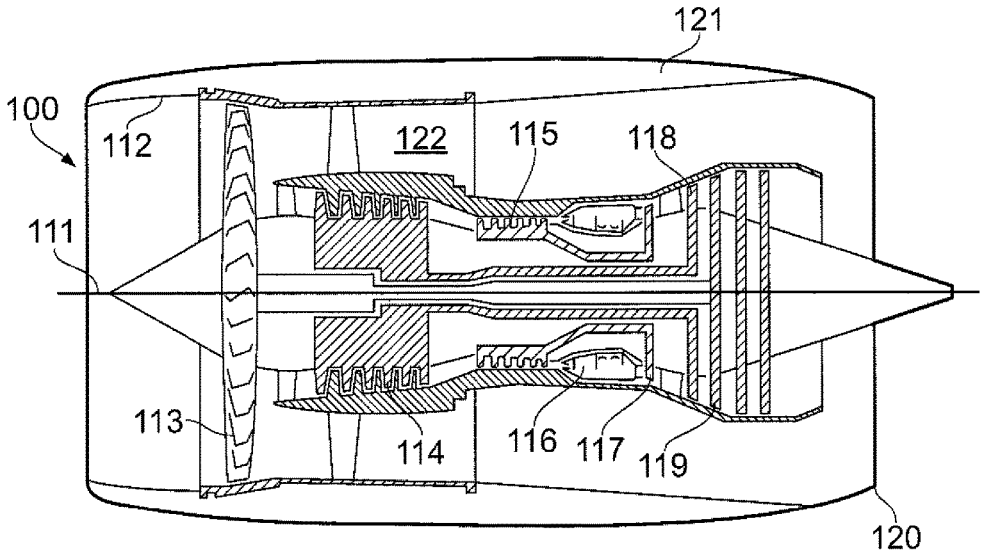
FIG. 1 is a sectional side view of a gas turbine engine.

With reference to FIG. 1, a gas turbine engine is generally indicated at 100, having a principal and rotational axis 111. The engine 110 comprises, in axial flow series, an air intake 112, a propulsive fan 113, an intermediate pressure compressor 114, a high-pressure compressor 115, combustion equipment 116, a high-pressure turbine 117, an intermediate pressure turbine 118, a low-pressure turbine 119 and an exhaust nozzle 120. A nacelle 121 generally surrounds the engine 110 and defines both the intake 112 and the exhaust nozzle 120.

The gas turbine engine 110 works in the conventional manner so that air entering the intake 112 is accelerated by the fan 113 to produce two air flows: a first air flow into the intermediate pressure compressor 114 and a second air flow which passes through a bypass duct 122 to provide propulsive thrust. The intermediate pressure compressor 114 compresses the air flow directed into it before delivering that air to the high pressure compressor 115 where further compression takes place.

The compressed air exhausted from the high-pressure compressor 115 is directed into the combustion equipment 116 where it is mixed with fuel and the mixture combusted. The resultant hot combustion products then expand through, and thereby drive the high, intermediate and low-pressure turbines 117, 118, 119 before being exhausted through the nozzle 20 to provide additional propulsive thrust. The high 117, intermediate 118 and low 119 pressure turbines drive respectively the high pressure compressor 115, intermediate pressure compressor 114 and fan 113, each by suitable interconnecting shaft.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

Figure 2:
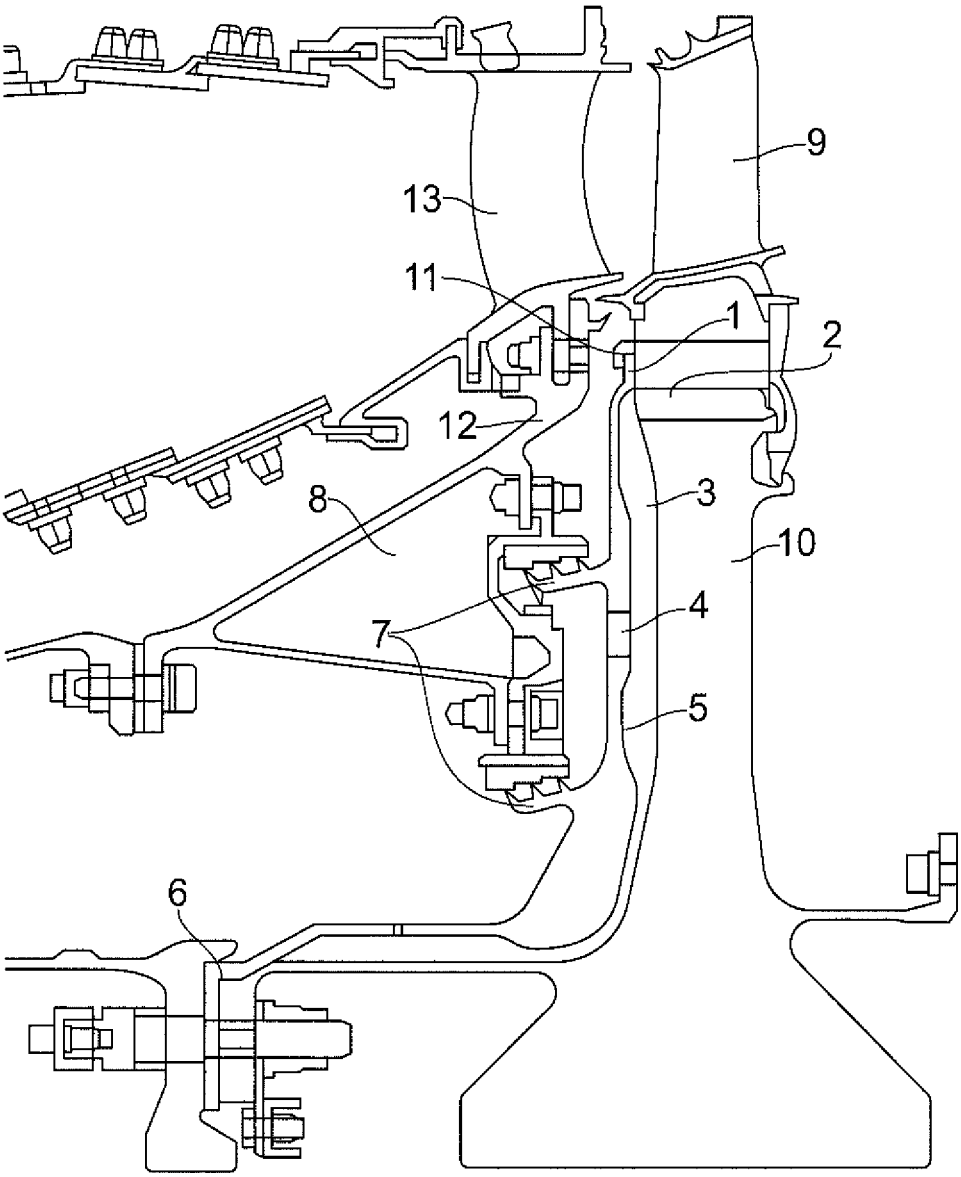
FIG. 2 (Prior Art)
FIG. 2 is a sectional side schematic view of half a turbine disc assembly as is known from the prior art.

FIG. 2 (discussed in more detail above) shows in more detail the structure of one high pressure turbine disc assembly (for example high pressure turbines 119 in the engine of FIG. 1) which is known from the prior art.

Figure 3:
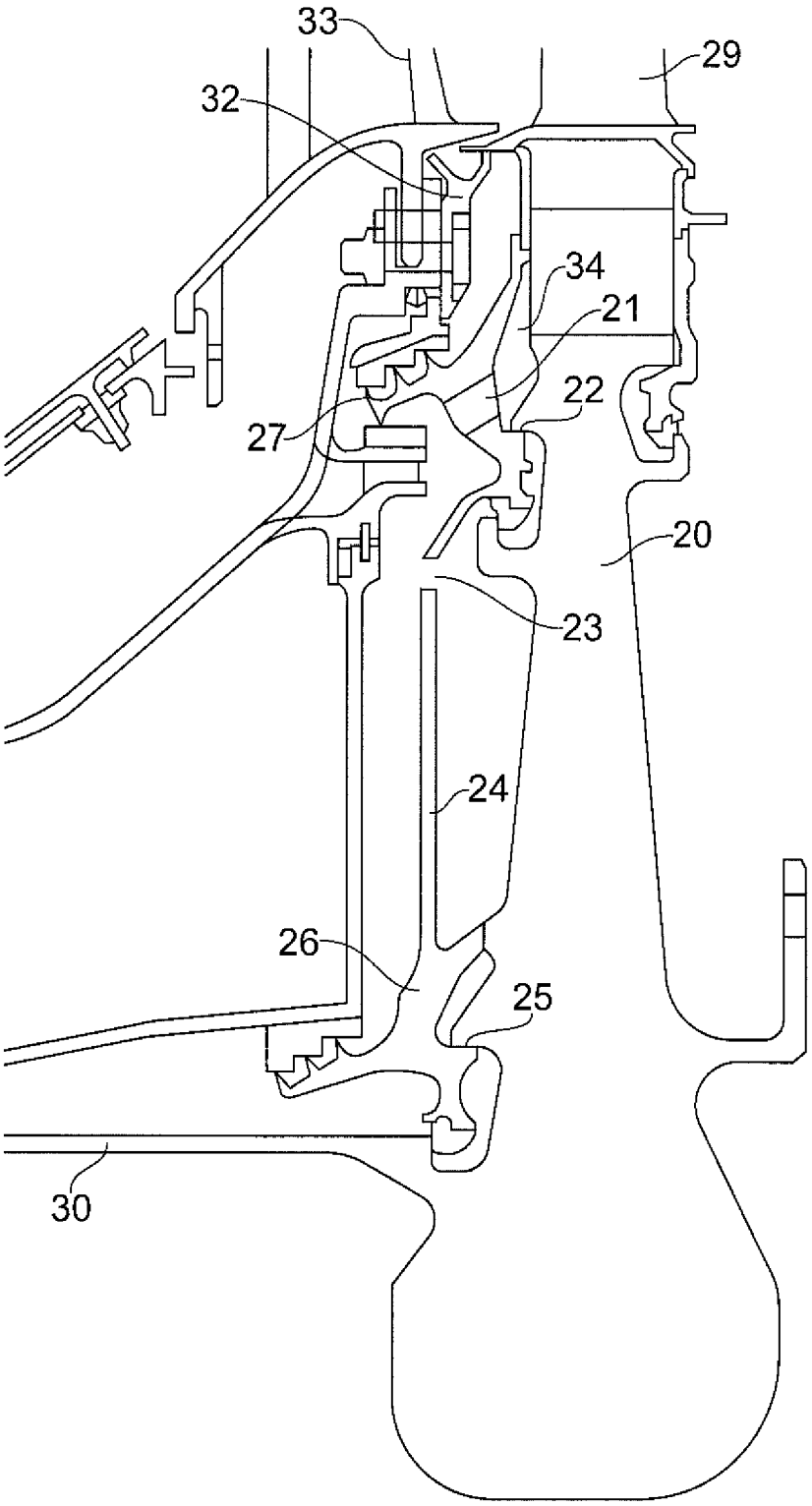
FIG. 3 is a sectional side schematic view of half a turbine disc assembly in accordance with a first embodiment of the invention.

FIG. 3 shows a high pressure turbine disc assembly in accordance with a first embodiment of the invention.

The assembly of FIG. 3 shows a disc 20 carrying blades 29. The disc is mounted on a shaft 30. A cover plate is arranged a short axial distance upstream of the disc 20 and comprises a radially inner component 26 and a radially outer component 27. The radially inner component 26 is attached to the disc 20 by means of a spigot 25 positioned radially adjacent the shaft 30. The radially outer component 27 is attached to the disc 20 by means of a second radial spigot 22 arranged towards a blade carrying outer perimeter of the disc 20. An annular seal plate 32 is suspended from an adjacent stator guide vane 33 and cooperates with an annular protrusion 33 of the radially outer component 27 to form a seal preventing ingress of hot working fluid into the region adjacent the disc 20. The radially outer component 27 is shaped with respect to the disc 20 to form a cavity 34 which is in fluid communication with the blade root 29.

The inner component 26 is less susceptible to high stresses induced by centrifugal loading and also higher temperatures that come with increased radius. The outer component is provided with coolant transfer holes 21 which place inner ducting of the blade in fluid communication with an axially adjacent chamber of coolant compressed air which has by-passed the combustor. The high pressure coolant for the blade 29 is ducted between the outer component 27 and the disc 20 into a coolant duct inlet provided in the blade 29 root. A radially extending surface 24 of the inner component 26 shields a radially inner extent of the disc 20 from oncoming coolant. There is a radial gap 23 between the inner 26 and outer 27 components.

Figure 4:
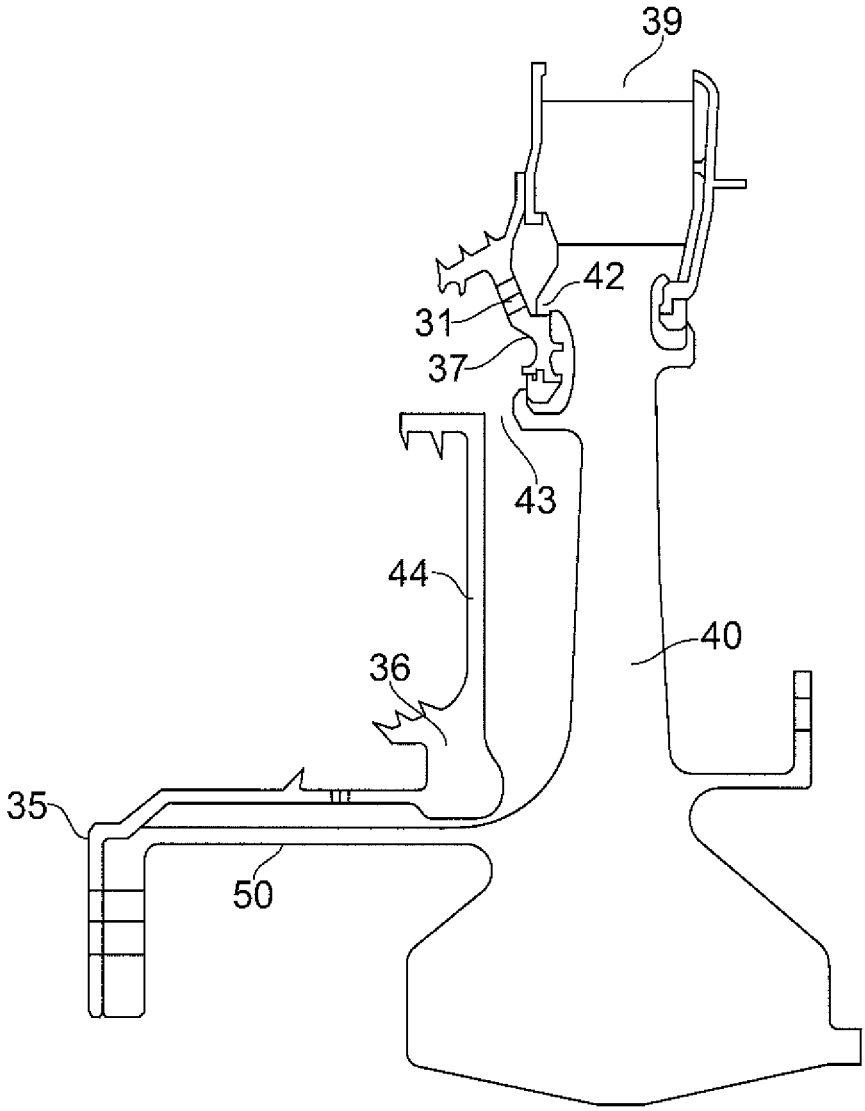
FIG. 4 is a sectional side schematic of half a turbine disc assembly in accordance with a second embodiment of the invention.

FIG. 4 shows an alternative embodiment of the invention. The figure shows a disc 40 carrying blades 39. The disc is mounted on a shaft 40. A cover plate is arranged a short axial distance upstream of the disc 30 and comprises a radially inner component 36 and a radially outer component 37. The radially inner component 36 is attached to the shaft 50 by means of a flange 35 positioned axially upstream. The inner component 36 is self-supporting. The radially outer component 37 is attached to the disc 30 by means of a radial spigot 42 arranged towards a blade carrying outer diameter of the disc 40.

Similarly to the embodiment of FIG. 3, the outer component 37 is provided with coolant transfer holes 31 which place inner ducting of the blade 39 in fluid communication with an axially adjacent chamber of coolant compressed air which has by-passed the combustor. The high pressure coolant for the blade 39 is ducted between the outer component 37 and the disc 40 into a coolant duct inlet provided in the blade 39 root. A radially extending surface 44 of the inner component 36 shields a radially inner extent of the disc 40 from oncoming coolant. Whilst not shown in the figure, the disc 40 may be shielded against ingress of hot work fluid by an annular seal plate similar to the seal plates 12 of FIG. 1 or 32 of FIG. 2. There is an axial gap 33 between the inner 36 and outer 37 components.

As can be seen from the two embodiments described and in particular that of FIG. 4, the radial extent of the radially inner component can extend across a large area of the disc 40. Since this component can be comprised of a less expensive and less high performing material, there is an opportunity for significant cost reductions. Furthermore, by appropriate choice of material and manufacturing processes (which each may differ for the radially inner and radially outer component) for the two components, there is opportunity to reduce the overall weight of the assembly compared to the prior art and to simplify the manufacturing process.

Some other benefits of embodiments of the invention can be summarised as follows:

In the prior art (see FIG. 2), the outer extremity 1 of the cover plate 5 slides radially during an engine cycle which can lead to wear of the cover plate 5 and/or disc 10 in that region. In embodiments of the present invention (see FIGS. 3 and 4) the outer component, 27, 37 benefits from greater freedom to optimise stress and life, its key design features not being influenced by material extending radially inwardly across the span of the disc. A gap 23, 43 between the components allows the outer component to react to its environment independently of the inner component.

In the prior art, the cover plate 5 is significantly larger than necessary to enable it to be mounted in the engine by means of the flange 6. Consequently, a large forging operation is required to manufacture the cover plate and this has a high associated cost. A large radial extent of this single component cover plate is necessarily made large to carry the high loads driven by centrifugal and thermal effects of carrying the most radially outer extent of the component. The single component cover plate is very large in a radial extent but thin in an axial dimension and is therefore challenging to manufacture to acceptable tolerances. The manufacturing complexity of the cover plate is significantly reduced when the cover plate is manufactured in two components in accordance with embodiments of the invention.

The occurrence of radial sliding and the extent of its implications can be significantly reduced with a separate radially outer component 27, 37 of the cover plate. With increasingly smaller radial extents of the outer component, the occurrence of radial sliding can be substantially eliminated. Also, it becomes possible to attach the radially outer component (and optionally the radially inner component) to the disc 20, 40 by means of a spigot 22, 42, 25. The load at spigot 42, 22 is significantly less than if a similar radial contact spigot were to be employed with a single component cover plate 5 of the prior art. Attachment using a spigot versus the flange arrangement 6 of the prior art enables a substantial reduction on the amount of material needed in the shield. The weight reduction may contribute to improved engine efficiency.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

What is claimed is:

1. A turbine disc assembly comprising a turbine disc mounted coaxially on a shaft and, in use, arranged in the path of a hot work fluid flow, a cover plate axially displaced from the turbine disc in a direction upstream with respect to the work fluid flow and an annular seal plate arranged adjacent an outer rim of the turbine disc to prevent the hot work fluid flow from penetrating a space axially adjacent the turbine disc, the cover plate comprising a radially inner annular disc component and a radially outer annular disc component, the annular disc components arranged coaxially with each other and arranged so as to permit relative axial and/or radial movement of the radially inner annular disc component and the radially outer annular disc component with respect to one another.

2. A turbine disc assembly as claimed in claim 1 wherein the annular disc components are arranged in radial alignment.

3. A turbine disc assembly as claimed in claim 1 wherein the annular disc components are axially spaced apart.

4. A turbine disc assembly as claimed in claim 3 wherein there is a radial overlap between the radially inner and radially outer annular disc components.

5. A turbine disc assembly as claimed in claim 1 wherein the annular disc components are axi-symmetric.

6. A turbine disc assembly as claimed in claim 1 wherein the radially outer annular disc component is provided with an annular array of coolant transfer holes through which coolant is delivered to a cavity between the outer annular disc component and the disc.

7. A turbine disc assembly as claimed in claim 1 wherein a seal portion of the seal plate cooperates with a seal portion of the outer annular disc component to seal against ingress of the hot work fluid flow.

8. A turbine disc assembly as claimed in claim 7 wherein the seal portion of the outer annular disc component comprises an annular flanged portion and/or a radial extension having a wedged or stepped profile.

9. A turbine disc assembly as claimed in claim 1 wherein the outer radius of the inner annular disc component is greater than 0.6 times the radius of the disc radius.

10. A turbine disc assembly as claimed in claim 1 wherein the radially outer component is secured to the turbine disc.

11. A turbine disc assembly as claimed in claim 1 wherein the radially inner annular disc component is secured to the turbine disc.

12. A turbine disc assembly as claimed in claim 10 wherein the component is secured to the disc by means of a spigot arranged on the disc.

13. A turbine disc assembly as claimed in claim 11 wherein the component is secured to the disc by means of a spigot arranged on the disc.

14. A turbine disc assembly as claimed in claim 1 wherein the radially inner annular disc component is secured to the shaft.

15. A turbine disc assembly as claimed in claim 1 wherein the radially inner annular disc component comprises a different material from the radially outer annular component.

16. A turbine disc assembly as claimed in claim 15 wherein the annular disc components both comprise an alloy and the inner annular disc component comprises a lower grade alloy than that of the outer annular disc component.

17. A turbine disc assembly as claimed in claim 1 wherein the radially inner annular disc component is thinner in an axial dimension than the radially outer annular disc component.

18. A gas turbine engine incorporating one or more turbine disc assemblies, the disc assemblies having a configuration as described in claim 1.

* * * * *